US006783609B2

(12) United States Patent
Hata et al.

(10) Patent No.: US 6,783,609 B2
(45) Date of Patent: Aug. 31, 2004

(54) HIGH-CARBON STEEL WIRE ROD WITH SUPERIOR DRAWABILITY AND METHOD FOR PRODUCTION THEREOF

(75) Inventors: Hideo Hata, Kobe (JP); Mamoru Nagao, Kobe (JP); Takaaki Minamida, Kakogawa (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 74 days.

(21) Appl. No.: 10/171,593

(22) Filed: Jun. 17, 2002

(65) Prior Publication Data

US 2003/0079815 A1 May 1, 2003

(30) Foreign Application Priority Data

Jun. 28, 2001 (JP) ..... 2001-196066

(51) Int. Cl.[7] ..... C22C 38/02; C22C 38/04; C21C 8/06

(52) U.S. Cl. ..... 148/320; 148/595; 148/598

(58) Field of Search ..... 148/320, 595, 148/598

(56) References Cited

U.S. PATENT DOCUMENTS

| | | | |
|---|---|---|---|
| 3,320,101 | A | 5/1967 | McLean et al. |
| 4,375,995 | A | 3/1983 | Sugino et al. |
| 5,211,772 | A | 5/1993 | Ashida et al. |
| 5,575,866 | A | 11/1996 | Minamida et al. |
| 5,873,958 | A | 2/1999 | Makii et al. |
| 6,217,678 | B1 | 4/2001 | Momozaki et al. |
| 6,322,641 | B1 | 11/2001 | Makii et al. |

FOREIGN PATENT DOCUMENTS

| | | |
|---|---|---|
| EP | 0 624 658 | 11/1994 |
| EP | 0 754 775 | 1/1997 |
| EP | 1 143 019 | 10/2001 |
| FR | 2 792 002 | 10/2000 |
| JP | 3-60900 | 9/1991 |
| JP | 4-346618 | 12/1992 |
| JP | 5-302120 | 11/1993 |
| JP | 6-49592 | 2/1994 |
| JP | 6-346190 | 12/1994 |
| JP | 8-283867 | 10/1996 |
| JP | 11-199977 | 7/1999 |
| JP | 11-199978 | 7/1999 |
| JP | 11-315348 | 11/1999 |
| JP | 2000-63987 | 2/2000 |
| WO | WO 01/23624 | 4/2001 |

OTHER PUBLICATIONS

Seitetsu Kenkyu. No. 295, 1978, pp. 52–63 (issued by Nippon Steel Corporation).

*Primary Examiner*—Deborah Yee
(74) *Attorney, Agent, or Firm*—Oblon, Spivak, McClelland, Maier & Neustadt, P.C.

(57) ABSTRACT

A high-carbon steel wire rod with superior drawability which has the chemical composition (in mass %) of C: 0.6–1.0%, Si: 0.1–1.5%, Mn: 0.3–0.9%, P: no more than 0.02%, S no more than 0.03%, N: no more than 0.005%, (optional Nb: 0.020–0.050% and V: 0.05–0.20%), with the remainder being Fe and inevitable impurities, and the structure which is characterized in that pearlite accounts for no less than 95 area % and pearlite has an average nodule diameter (P $\mu$m) no larger than 30 $\mu$m and an average lamella space (S nm) no smaller than 100 nm such that the value of F calculated by the formula below is larger than zero $$F=350.3/\sqrt{S}+130.3/\sqrt{P}-51.7.$$

8 Claims, 2 Drawing Sheets

HIGH-CARBON STEEL WIRE ROD WITH SUPERIOR DRAWABILITY AND METHOD FOR PRODUCTION THEREOF

BACKGROUND OF THE INVENTION

1. Field of the Invention

The present invention relates to a high-carbon steel wire rod to be made into steel wires for tire reinforcement, steel wires for prestressed concrete, and steel wires for ropes. The present invention relates also to a method for production of the same.

2. Description of Related Arts

High-strength steel wires are produced by drawing from high-carbon steel wire rods obtained by hot rolling. Those steel wire rods to be drawn into thin wires (such as tire cords and belt cords) need good drawability because their breakage at the time of drawing seriously impedes productivity. A conventional way to achieve good drawability was to subject hot wire rods to water quenching and ensuing air-blast quenching after hot rolling, thereby creating fine pearlite in the structure of the wire rods. Moreover, good drawability is ensured by intermediate patenting which is carried out once or twice during drawing.

There is a demand for high-carbon steel wires having a smaller diameter than before. Moreover, omission of intermediate patenting is required for improvement in productivity. Under these circumstances, high-carbon steel wire rods need good breakage resistance as well as good drawability for prolonged die life.

Japanese Patent Publication No. 60900/1991 discloses a technology to improve drawability by adequately controlling tensile strength per carbon equivalent in high-carbon wire rods and also by adequately controlling the ratio of coarse pearlite (distinguishable under a ×500 microscope) in pearlite. Japanese Patent Laid-open No. 63987/2000 also discloses a technology to improve drawability by reducing the average diameter of pearlite colony below 150 μm and by controlling the average lamella space between 0.1 and 0.4 μm. The pearlite colony refers to a domain in which pearlite lamellas are oriented in one direction. A plurality of pearlite colonies form a nodule (or block) in which the crystal orientation is fixed. Incidentally, according to the above-mentioned patent publications, hot-rolled wire rods undergo water quenching for adequate winding temperature and subsequent air-blast quenching with a Stelmore conditioning cooling apparatus.

Unfortunately, the above-mentioned first technology does not provide sufficient breakage resistance as well as good drawability despite its contribution to prolong die life owing to the presence of coarse pearlite (about 10–30%) with a large lamella space. By contrast, the above-mentioned second technology contributes to prolonged die life on account of a larger lamella space (0.1 to 0.4 μm); but such a large lamella space results in an average colony diameter of about 40 μm (as illustrated in the example), which is detrimental to good drawability.

Incidentally, it has been reported that wire breakage is effectively prevented by increasing the lamella space and the pearlite nodule (block) size. ("Seitetsu Kenkyu" No. 295, pp. 520–63, 1978, issued by Nippon Steel Corporation) This report is based on the results of experiments with a high-carbon steel wire rod containing 1–2 wt % Cr. Moreover, it does not pay attention to the die life nor does it discuss the relation between the lamella space and the nodule size from the standpoint of drawability in relation to die life.

OBJECT AND SUMMARY OF THE INVENTION

The present invention was completed in view of the foregoing. Accordingly, it is an object of the present invention to provide a high-carbon steel wire rod with superior drawability and a method for production thereof. The high-carbon steel wire rod has good resistance to breakage and contributes to prolonged die life.

The present inventors believed it essential for prolonged die life to enlarge the lamella space of pearlite to a certain extent, thereby slightly reducing the strength of wire rods. Based on this belief, they carried out extensive studies to suppress or prevent wire breakage. As the result, it was found that a wire rod has good breakage resistance and superior drawability so long as it contains pearlite nodules having an average diameter smaller than a certain value even though it has pearlite structure with a comparatively large lamella space. This finding led to the present invention.

The first aspect of the present invention resides in a high-carbon steel wire rod which has the chemical composition (in mass %) defined below:

C: 0.6–1.0%
Si: 0.1–1.5%
Mn: 0.3–0.9%
P: no more than 0.02%
S: no more than 0.03%
N: no more than 0.005% with the remainder being Fe and inevitable impurities, and the structure which is characterized in that pearlite accounts for no less than 95 area % and pearlite has an average nodule diameter (P μm) no larger than 30 μm and an average lamella space (S nm) no smaller than 100 nm such that the value of F calculated by the formula below is larger than zero.

ti $F=350.3/\sqrt{\bar{S}}+130.3/\sqrt{\bar{P}}-51.7$

The chemical composition may additionally have either or both of the following components.

Nb: 0.020–0.050%
V: 0.05–0.20%

The chemical composition may have an optional component of Al in an amount no more than 0.030% and may contain N in an amount ranging from 0.0015 to 0.0050%.

The second aspect of the present invention resides in a method for producing a high-carbon steel wire rod which comprises the steps of subjecting a billet having the above-mentioned chemical composition to hot-rolling with a finish temperature of 1050–800° C., cooling immediately the hot-rolled rod to a temperature of 950–750° C. at a cooling rate no smaller than 50° C./s, cooling further the rod to a temperature of 620–680° C. at a cooling rate of 5–20° C./s, cooling the rod for no less than 20 seconds at a cooling rate no larger than 2° C./s. The above-mentioned method may have an additional step of further cooling the cooled rod to a temperature no higher than 300° C. at a cooling rate no smaller than 5° C./s.

DESCRIPTION OF THE PREFERRED EMBODIMENTS

Figure 1:
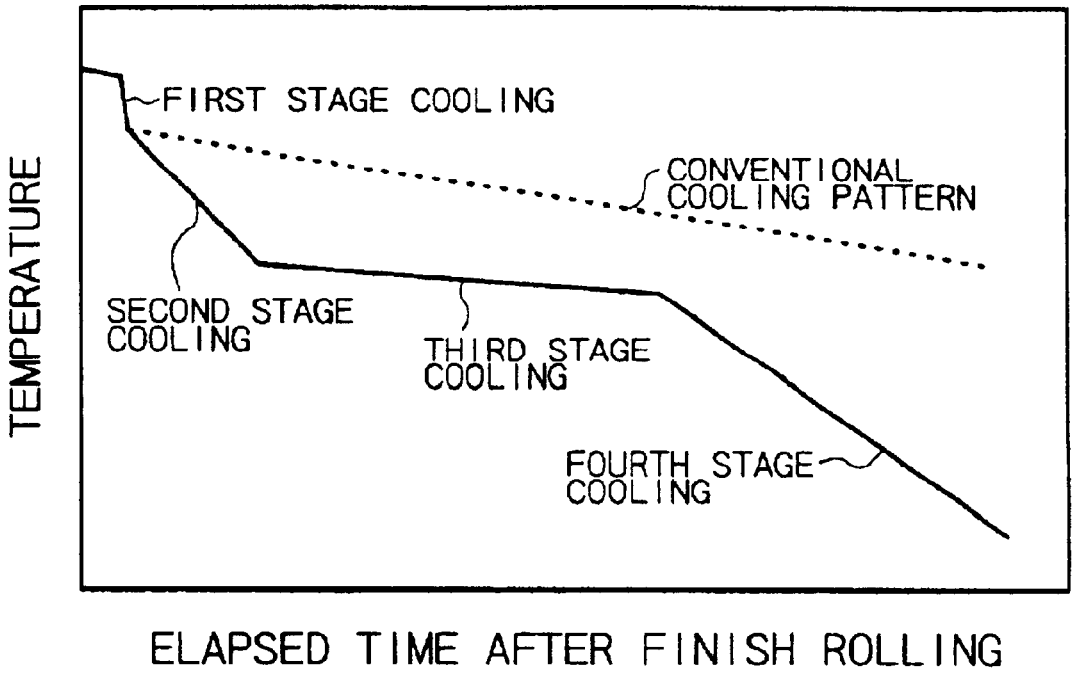
FIG. 1 is a cooling curve representing the cooling step that follows hot rolling in the production of the high-carbon steel wire rod according to the present invention.
Figure 2:
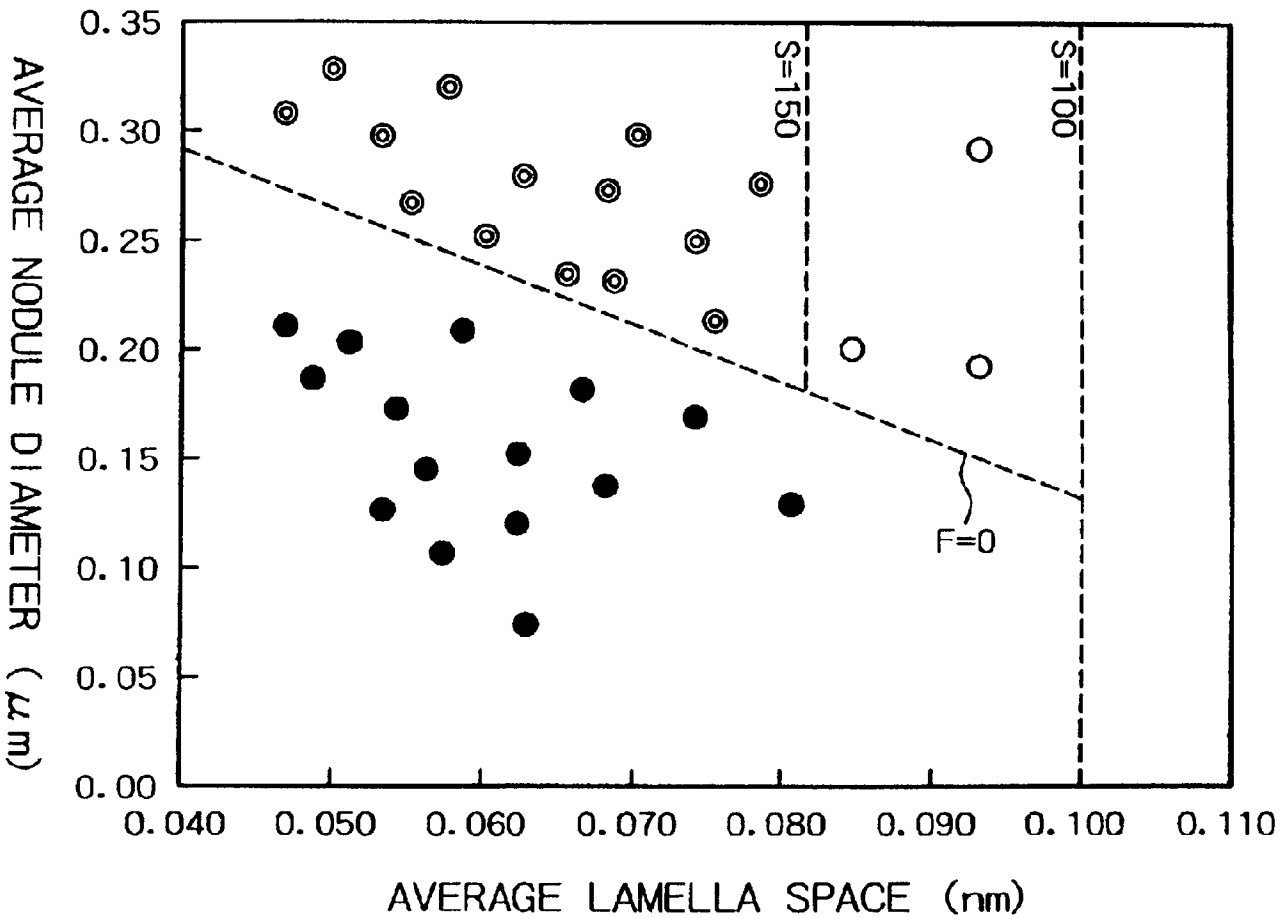
FIG. 2 is a graph showing how drawability depends on the average nodule diameter and the average lamella space which were observed in Examples.

According to the present invention, the high-carbon steel wire rod should have a specific chemical composition (in terms of mass %) as explained in the following.

C: 0.6–1.0%

Carbon is a basic element contributing to strength. With a content less than 0.6%, carbon gives rise to pro-eutectoid ferrite excessively. The resulting steel does not have the structure composed mainly of pearlite and hence is poor in strength. By contrast, with a content more than 1.0%, carbon gives rise to pro-eutectoid cementite, which deteriorates drawability.

Si: 0.1–1.5%

Silicon enhances strength through deoxidation and solid-solution strengthening. With a content less than 0.1%, silicon does not fully produce its effect. With a content more than 1.5%, silicon deteriorates drawability due to excessive solid-solution strengthening of ferrite.

Mn: 0.3–0.9%

Manganese enhances strength through deoxidation and solid-solution strengthening. With a content less than 0.3%, manganese does not fully produce its effect. With a content more than 0.9%, manganese deteriorates drawability due to excessive solid-solution strengthening of ferrite. In addition, manganese is liable to segregation and hence excessive manganese results in an inconsistent structure which deteriorates drawability.

P: no more than 0.02%

Phosphorous is an impurity element. The content of phosphorus should be as small as possible. Phosphorus results in solid-solution strengthening of ferrite, thereby adversely affecting drawability. Therefore, the content of phosphorus should not exceed 0.02%.

S: no more than 0.03%

Sulfur is an impurity element, which forms MnS (as inclusion) to deteriorate drawability. Therefore, the content of sulfur should not exceed 0.03%.

N: no more than 0.005%

Nitrogen is also an impurity element. It forms a solid solution with ferrite, which brings about age strengthening due to heat generation during drawing. This adversely affects drawability to a great extent. Therefore, the content of phosphorus should not exceed 0.005%. The smaller, the better.

The high-carbon steel wire rod of the present invention should typically be composed of the above-mentioned components, with the remainder being Fe and inevitable impurities. However, for improvement in its characteristic properties, it may be incorporated with any additional element in an amount not detrimental to the above-mentioned functions and effects. For example, it may be incorporated with either or both of Nb and V according to need as explained below.

Nb: 0.020–0.050%

V: 0.05–0.20%

These elements suppress the recovery, recrystallization, and grain growth of austenite, thereby promoting pearlite transformation, decreasing tensile strength (TS), and reducing the nodule size. This leads to improved drawability. Nb and V do not contribute to the above-mentioned functions if their content is less than 0.020% and 0.05%, respectively. Hence, their lower limits are 0.020% and 0.05%, respectively. On the other hand, Nb and V rather deteriorate drawability due to precipitation strengthening if their contents exceed 0.050% and 0.20%, respectively. Hence, their upper limits are 0.050% and 0.20%, respectively. Vanadium improves hardenability; but it does not increase strength excessively and hence it does not deteriorate drawability so long as it is added in an amount specified above.

Al: no more than 0.030%

N: 0.0015–0.005%

Moreover, a trace amount of aluminum causes AlN to precipitate out, thereby keeping the nodule size fine in the rolled wire rode. Reduction in nodule size improves drawability and improved drawability permits high-speed drawing. In order to produce this effect, it is desirable to add Al in an amount no less than 0.006%. However, aluminum may have an adverse effect on drawability in the case of thin high-carbon steel wire, such as tire cords and saw wires which are 0.5 mm or less in diameter. In such thin wires, aluminum forms inevitable inclusions at which Cuppy breakage start. Therefore, aluminum should be used for wires larger than 0.5 mm in diameter. Aluminum in an excess amount causes AlN to precipitate out excessively, thereby impeding high-speed drawing. Consequently, the aluminum content should preferably be no more than 0.030%. Incidentally, when aluminum is added, the nitrogen content in the steel should be no less than 0.0015%. Aluminum and nitrogen in an adequately controlled amount permit the precipitation of AlN as desired.

According to the present invention, the high-carbon steel wire rod should have a specific structure (which relates to drawability and die life) as explained in the following.

It is necessary to lower the strength of wire rod (rolled product) in order to extend the die life. It is known that tensile strength TS (MPa) is determined by lamella space S (nm) and there is a relation between TS and S as follows:

$$TS=\sigma_0+KS^{-1/2} \text{ (where } \sigma_0 \text{ and } K \text{ are constants)}$$

This equation suggests that it is necessary to increase the average lamella space S in order to extend the die life.

In the initial stage of drawing where strain (or reduction of area) is still small, individual nodules of pearlite rotate in such a way that lamellas align them selves parallel to the drawing direction. If the lamella space is large, this rotation does not take place smoothly and voids tend to occur. Voids induce breakage called Cuppy breakage, and hence voids deteriorate drawability.

The production of wire rods involves water quenching and ensuing air-blast quenching after hot rolling, and it has been common practice to reduce the amount of air-blast so at to increase the lamella space. In this way it is possible to form pearlite with a large lamella space; however, the nodule size inevitably becomes large. In other words, there is a trade-off between extension of die life through lowering of strength and improvement of drawability through reduction of nodule size. Incidentally, the amount of air-blast is reduced but is never reduced to zero in the conventional production method.

According to the present invention, it is possible to greatly reduce the nodule size while keeping wide the lamella space of pearlite. This is achieved by performing the air-blast quenching (in the cooling step that follows hot rolling) under special conditions in which the amount of air-blast could be reduced to zero, as mentioned later. With a sufficiently small size, nodules smoothly rotate at the time of drawing even though the lamella space is large. Smooth nodule rotation prevents voids and hence Cuppy breakage. For this reason, the wire rod of the present invention has superior drawability despites its low strength, and hence it permits high-speed drawing without breakage and it extends die life.

According to the present invention, the structure of the wire rod is characterized by a large area ratio of pearlite (preferably larger than 95 area %). The wire rod would be poor in drawability if other structure than pearlite (e.g., ferrite and bainite) accounts for more than 5%. Incidentally, ferrite lowers strength and hence the final product (steel wire) with ferrite is poor in strength.

The above-mentioned pearlite should have an average nodule diameter no larger than 30 μm. Nodules with an average diameter larger than 30 μm do not rotate smoothly. This leads to frequent breakage and hence poor drawability. The average lamella space of pearlite should be no smaller than 100 nm, preferably no smaller than 150 nm. With a lamella space smaller than 100 nm, the wire rod has high strength and hence shortens the die life. The upper limit of the average lamella space should be such that the value of F calculated by the following equation is larger than zero. (F>0).

$$F=350.3/\sqrt{S}+130.3/\sqrt{P}-51.7$$

(where S (nm) is the average lamella space and P (μm) is the average nodule diameter.)

This equation was derived from the examples mentioned later. It determines the limit at which the liability to breakage due to lowered strength is cancelled by the reduced nodule diameter as the lamella space increases.

The high-carbon steel wire rod of the present invention can be industrially produced in the following manner. First, a high-carbon steel having the above-mentioned chemical composition is prepared. Then, the steel is made into billets by continuous casting or blooming. After heating (if necessary), each billet undergoes hot rolling with a finish temperature of 1050–800° C. Hot rolling in this manner suppresses the recovery, recrystallization, and grain growth of austenite, thereby keeping strength and giving rise to fine nodules. The lower limit of finish temperature should be higher than 800° C., preferably higher than 900° C., so as to avoid excessive load on the rolling mill.

Cooling after hot rolling should be carried out under a specific condition which is particularly important in the present invention. The cooling condition will be described in detail with reference to FIG. 1. The broken line in FIG. 1 represents the conventional cooling pattern which is employed to increase the lamella space. Cooling with a uniformly decreasing cooling rate cannot reduce the nodule diameter sufficiently. Thus the conventional cooling method presents a trade-off between good drawability and prolonged die life. The solid line in FIG. 1 represents the cooling pattern in the present invention. This cooling pattern is necessary to realize the above-mentioned pearlite structure which provides adequate low strength and high breakage resistance.

Immediately after finish rolling, the wire rod is quenched to a temperature of 950–750° C. at a cooling rate no smaller than 50° C./s. (First stage cooling) Quenching in this manner suppresses the recovery, recrystallization, and grain growth of austenite, lowers the strength of the wire rod, and makes pearlite nodules finer. The temperature at which the first stage cooling terminates is specified so that scale forms adequately and yet descaling is possible in the second stage cooling (mentioned later). Scale relates closely to drawability. Good descalability is necessary to eliminate residual scale and ensure a good surface state. (Residual scale increases die friction, reduces die life, and deteriorates drawability.) In order for scale to form adequately, the first stage cooling should terminate at a temperature of 750–950° C. Cooling below 750° C. prevents scale growth and makes descaling difficult. On the other hand, cooling above 950° C. gives rise to excessively thick scale which is difficult to remove. In addition, cooling above 950° C. implies that the wire rod is exposed to a high temperature for a long time in the subsequent cooling stages. Cooling in this manner, therefore, permits austenite grains to grow and prevents fine nodules from occurring. The first stage cooling is accomplished typically by water-quenching the wire rod after hot rolling.

The first stage cooling is followed by the second stage cooling in which the wire rod is cooled to a temperature of 620–680° C. at a cooling rate of 5–20° C./s. If the cooling rate is smaller than 5° C./s, pearlite transformation takes place at a temperature higher than 680° C. Transformation at 680° C. or above takes place such that the number of pearlite nuclei is limited and hence the number of pearlite grains is limited. This results in a large nodule size, which leads to poor drawability. By contrast, if the cooling rate is greater than 20° C./s, the second stage cooling prevents scale growth, which leads to poor descalability. Cooling below 620° C. results in a narrow lamella space which leads to excessively high strength and hence die wear. By contrast, cooling to a temperature higher than 680° C. causes pearlite transformation to take place at high temperatures, and hence the resulting wire rod is poor in drawability. The second stage cooling is accomplished typically by air-blast quenching, with the amount of air adequately controlled.

The second stage cooling is followed by the third stage cooling, in which the wire rod is cooled for more than 20 seconds at a cooling rate no greater than 2° C./s. Cooling in this manner causes pearlite transformation to take place at a low temperature. Consequently, there are a large number of pearlite nuclei, which gives rise to fine nodules. If the cooling rate is greater than 2° C./s or the cooling time is shorter than 20 seconds, the wire rod decreases in temperature rapidly and hence pearlite transformation takes place at low temperatures. This gives rise to pearlite having a narrow lamella space and causes the wire rod to increase in strength, which adversely affects the die life. The third stage cooling is carried out in such a way that air-blast cooling is suspended for a prescribe period of time (or the amount of air is reduced to zero), although this condition is not mandatory. Heat generation due to pearlite transformation is utilized.

The third stage cooling is followed by the fourth stage cooling (optional), in which the wire rod is cooled below 300° C. at a cooling rate no smaller than 5° C. Cooling in this way improves scale properties and hence improves drawability. Cooling which terminates at 300° C. or above causes scale to peel off, with the exposed surface forming very thin scale, which makes descaling difficult. Cooling at a cooling rate smaller than 5° C./s takes a long time until the temperature goes down below 300° C. and hence it is unfavorable to productivity.

Now, the invention will be described in more detail with reference to the following examples, which are not intended to restrict the scope thereof.

EXAMPLE A

A high-carbon steel having the composition (shown below) specified in the present invention was prepared by using a converter. The steel was made into billets (155 mm square) by blooming. Each billet was heated at about 1150° C. and then hot-rolled to give a wire rod, 5.5 mm in diameter. The hot-rolled wire rod was passed through an atmospheric heating furnace at 880–1100° C. and a fluidized bed at 580–690° C. sequentially, so that the structure of the wire rod underwent pearlite transformation. The heating temperature and the wire running speed were adequately controlled so that austenite had a grain size of 10–20 μm. The smaller the austenite grain size, the smaller the nodule diameter, and the larger the austenite grains size, the larger the nodule diameter. (This proportional relation slightly changes depending on the temperature of the fluidize bed.) On the other hand, the lamella space increased in proportion to the temperature of the fluidized bed. By establishing these temperatures variously, there were obtained experimentally wire rod samples varying in lamella space and nodule diameter.

These samples were measured for pearlite area ratio, average nodule diameter, average lamella space, and tensile strength.

The pearlite area ratio was obtained by observing the structure in the cross section of a wire rod sample under an SEM (scanning electron microscope, ×1000) after mirror-polishing and etching with a mixture of nitric acid and ethanol. The SEM was focused on the middle point of the radius extending from the center of the cross section to the surface of the wire rod.

The average nodule diameter was also obtained by observing the sample prepared in the same way as mentioned above under an optical microscope (×100) according to JIS G0552 (stipulating the method for measuring ferrite grain size). The grain number G was calculated down to the first place of decimals, and it was converted into the nodule diameter (μm) by the following formula.

$$\text{Nodule diameter } (\mu m) = 10 \times 2^{(10-G)/2}$$

The average lamella space was obtained in the following manner. The cross section of the sample, which had undergone mirror-polishing and etching in the same way as mentioned above, was observed under an SEM (×5000). Ten observations were made on the middle point of the radius extending from the center of the cross section to the surface of the wire rod. Each electron micrograph was examined to find three points where there exists the finest lamella structure. A straight line was drawn perpendicular to the lamella, and the lamella space was obtained from the length of the line and the number of lamellas crossing the line. The values obtained from ten observations were averaged to give the average lamella space.

The drawability was evaluated by actually drawing the above-mentioned wire rod in the following manner. The wire rod sample was completely descaled by dipping in hydrochloric acid and then lubricated with phosphoric acid. Subsequently, the wire rod was drawn into a wire having a diameter of 1.0 mm by a multi-stage dry drawing machine. Drawing was accomplished at an ordinary speed (300 m/min) or at a high speed (600 m/min). This speed denotes the final drawing speed.

The breakage resistance was rated according to whether or not 100 tons of wire rod broke during drawing. The die which had permitted break-free drawing was examined for the surface state and rated according to the following criterion.

○: No scratches are found on the die surface.

Δ: Short scratches are found on the die surface.

X: Long scratches are found on the die surface.

The die was also examined for wear and the die life was rated according to the following criterion.

○: Very little wear, without die cracking.

Δ: Slight wear, without die cracking.

X : Sever wear, with die cracking.

The results of measurements and observations are shown in Table 1. The values of F calculated from the above-mentioned formula are also shown in Table 1. The relation between the average lamella space and the average nodule diameter (in drawing at 600 m/min) is shown in Table 1. Incidentally, the above-mentioned formula for F was obtained from the boundary lines separating the three marks (◎, Δ, ●) which corresponds to ○, Δ, and X, respectively, in Table 1. The boundary lines are indicated by broken lines.

TABLE 1

| | Structure and properties of wire rod | | | | | Drawing speed (300 m/min) | | | | Drawing speed (600 m/min) | | | |
|---|---|---|---|---|---|---|---|---|---|---|---|---|---|
| Sample No. | Pearlite area ratio (%) | Average lamella space (nm) | Average nodule diameter (μm) | Value of F | TS (MPa) | Breakage | Surface state | Die life | Overall rating | Breakage | Surface state | Die life | Overall rating |
| 1 | 98 | 115 | 27.5 | 5.8 | 1162 | None | ○ | ○ | ○ | None | Δ | Δ | Δ |
| 2 | 98 | 115 | 11.7 | 19.1 | 1162 | None | ○ | ○ | ○ | None | Δ | Δ | Δ |
| 3 | 97 | 139 | 25.2 | 4.0 | 1103 | None | ○ | ○ | ○ | None | Δ | Δ | Δ |
| 4 | 97 | 162 | 13.3 | 11.6 | 1059 | None | ○ | ○ | ○ | None | ○ | ○ | ○ |
| 5 | 97 | 398 | 9.3 | 8.6 | 860 | None | ○ | ○ | ○ | None | ○ | ○ | ○ |
| 6 | 98 | 175 | 22.3 | 2.4 | 1038 | None | ○ | ○ | ○ | None | ○ | ○ | ○ |
| 7 | 97 | 182 | 16.2 | 6.7 | 1028 | None | ○ | ○ | ○ | None | ○ | ○ | ○ |
| 8 | 98 | 353 | 11.3 | 5.7 | 882 | None | ○ | ○ | ○ | None | ○ | ○ | ○ |
| 9 | 97 | 203 | 11.3 | 11.7 | 1001 | None | ○ | ○ | ○ | None | ○ | ○ | ○ |
| 10 | 99 | 212 | 18.9 | 2.4 | 990 | None | ○ | ○ | ○ | None | ○ | ○ | ○ |
| 11 | 97 | 215 | 13.5 | 7.7 | 987 | None | ○ | ○ | ○ | None | ○ | ○ | ○ |
| 12 | 98 | 232 | 18.4 | 1.7 | 969 | None | ○ | ○ | ○ | None | ○ | ○ | ○ |
| 13 | 97 | 254 | 12.9 | 6.6 | 948 | None | ○ | ○ | ○ | None | ○ | ○ | ○ |
| 14 | 96 | 276 | 15.9 | 2.1 | 931 | None | ○ | ○ | ○ | None | ○ | ○ | ○ |
| 15 | 95 | 301 | 9.8 | 10.1 | 913 | None | ○ | ○ | ○ | None | ○ | ○ | ○ |
| 16 | 95 | 328 | 14.1 | 2.4 | 896 | None | ○ | ○ | ○ | None | ○ | ○ | ○ |
| 17 | 95 | 455 | 10.6 | 4.8 | 837 | None | ○ | ○ | ○ | None | ○ | ○ | ○ |
| 21* | 95 | 154 | 62.0 | −6.9 | 1073 | None | ○ | ○ | ○ | Yes | — | — | X |
| 22* | 96 | 216 | 54.0 | −10.1 | 986 | None | ○ | ○ | ○ | Yes | — | — | X |
| 23* | 96 | 455 | 22.8 | −8.0 | 837 | None | ○ | ○ | ○ | Yes | — | — | X |
| 24* | 95 | 317 | 49.4 | −13.5 | 902 | None | Δ | Δ | Δ | Yes | — | — | X |
| 25* | 95 | 254 | 191.0 | −20.3 | 948 | None | — | — | X | Yes | — | — | X |
| 26* | 96 | 258 | 44.4 | −10.3 | 945 | None | ○ | ○ | ○ | Yes | — | — | X |
| 27* | 96 | 306 | 90.6 | −18.0 | 909 | Yes | — | — | X | Yes | — | — | X |
| 28* | 97 | 353 | 64.4 | −16.8 | 882 | None | — | — | X | Yes | — | — | X |
| 29* | 98 | 341 | 34.4 | −10.5 | 888 | None | ○ | ○ | ○ | Yes | — | — | X |
| 30* | 95 | 421 | 29.4 | −10.6 | 850 | None | ○ | ○ | ○ | Yes | — | — | X |
| 31* | 92 | 58 | 43.0 | 14.2 | 1429 | None | X | X | X | Yes | — | — | X |
| 32* | 96 | 383 | 24.4 | −7.4 | 867 | None | ○ | ○ | ○ | Yes | — | — | X |

TABLE 1-continued

| | Structure and properties of wire rod | | | | | Drawing speed (300 m/min) | | | | Drawing speed (600 m/min) | | | |
|---|---|---|---|---|---|---|---|---|---|---|---|---|---|
| Sample No. | Pearlite area ratio (%) | Average lamella space (nm) | Average nodule diameter (μm) | Value of F | TS (MPa) | Breakage | Surface state | Die life | Overall rating | Breakage | Surface state | Die life | Overall rating |
| 33* | 97 | 182 | 36.2 | −4.1 | 1028 | None | ○ | ○ | ○ | Yes | — | — | X |
| 34* | 97 | 226 | 31.0 | −5.0 | 975 | None | ○ | ○ | ○ | Yes | — | — | X |
| 35* | 96 | 291 | 23.3 | −4.1 | 919 | None | ○ | ○ | ○ | Yes | — | — | X |
| 36* | 95 | 259 | 71.1 | −14.5 | 944 | None | Δ | Δ | Δ | Yes | — | — | X |

Asterisked sample numbers denote comparative examples.

It is noted from Table 1 that samples Nos. 1 to 17 (working examples) which have the average lamella space, average nodule diameter, and F value as specified in the present invention gave good results regardless of drawing speed. Samples Nos. 4 to 17, which have an average lamella space larger than 150 nm and an adequate F value, are particular superior in drawability. By contrast, samples Nos. 21 to 36 (comparative examples), which have an F value smaller than zero (except for No. 31), are extremely poor in drawability. All of them broke in high-speed drawing. Sample No. 31, which has an excessively small pearlite content and an average lamella space smaller than 100 nm, was poor in surface state and caused die cracking even in low-speed drawing.

EXAMPLE B

Steel sample varying in composition as shown in Table 2 were prepared. Each steel was made into hot-rolled wire rods, 5.5 mm in diameter, having the pearlite structure, in the same way as in Example A. The resulting wire rod samples were examined for tensile strength, pearlite area ratio, average lamella space, average nodule diameter, and drawability. The samples containing aluminum were additionally examined for drawability at a higher speed (800 m/min). The results are shown in Tables 3 and 4.

TABLE 2

| Sample | Chemical composition (mass %, remainder: substantially Fe) | | | | | | |
|---|---|---|---|---|---|---|---|
| No. | C | Si | Mn | P | S | N | Others |
| 1 | 0.822 | 0.198 | 0.512 | 0.008 | 0.009 | 0.0031 | |
| 2 | 0.695 | 0.221 | 0.712 | 0.007 | 0.008 | 0.0035 | |
| 3 | 0.905 | 0.212 | 0.558 | 0.008 | 0.007 | 0.041 | |
| 4 | 0.819 | 0.802 | 0.491 | 0.005 | 0.006 | 0.0029 | |
| 5 | 0.820 | 1.310 | 0.551 | 0.008 | 0.007 | 0.0038 | |
| 6 | 0.809 | 0.202 | 0.803 | 0.005 | 0.007 | 0.0039 | |
| 7 | 0.818 | 0.209 | 0.489 | 0.011 | 0.009 | 0.0041 | Nb: 0.026 |
| 8 | 0.809 | 0.21 | 0.505 | 0.007 | 0.009 | 0.0042 | V: 0.15 |
| 9 | 0.826 | 0.172 | 0.489 | 0.005 | 0.006 | 0.0040 | Nb: 0.024, V: 0.06 |
| 21* | 0.819 | 0.209 | 0.506 | 0.008 | 0.009 | 0.0038 | Nb: 0.072 |
| 22* | 0.807 | 0.199 | 0.497 | 0.006 | 0.007 | 0.0043 | V: 0.28 |
| 30 | 0.776 | 0.181 | 0.352 | 0.007 | 0.010 | 0.0040 | Al: 0.015 |
| 31 | 0.772 | 0.182 | 0.367 | 0.006 | 0.009 | 0.0037 | Al: 0.006 |
| 32 | 0.816 | 0.190 | 0.401 | 0.006 | 0.007 | 0.0045 | Al: 0.029 |
| 40 | 0.781 | 0.191 | 0.397 | 0.004 | 0.012 | 0.0003 | Al: 0.010 |
| 41* | 0.793 | 0.179 | 0.387 | 0.006 | 0.010 | 0.0055 | Al: 0.011 |
| 42 | 0.820 | 0.201 | 0.400 | 0.005 | 0.005 | 0.0034 | Al: 0.032 |

Asterisked sample numbers denote comparative examples.

TABLE 3

| | Structure and properties of wire rod | | | | | Drawing speed (300 m/min) | | | | Drawing speed (600 m/min) | | | |
|---|---|---|---|---|---|---|---|---|---|---|---|---|---|
| Sample No. | Pearlite area ratio (%) | Average lamella space (nm) | Average nodule diameter (μm) | Value of F | TS (MPa) | Breakage | Surface state | Die life | Overall rating | Breakage | Surface state | Die life | Overall rating |
| 1 | 97 | 219 | 17.2 | 3.4 | 983 | None | ○ | ○ | ○ | None | ○ | ○ | ○ |
| 2 | 96 | 210 | 18.6 | 2.7 | 992 | None | ○ | ○ | ○ | None | ○ | ○ | ○ |
| 3 | 96 | 194 | 19.8 | 2.7 | 1011 | None | ○ | ○ | ○ | None | ○ | ○ | ○ |
| 4 | 97 | 191 | 24.2 | 0.2 | 1016 | None | ○ | ○ | ○ | None | ○ | ○ | ○ |
| 5 | 98 | 149 | 24.4 | 2.8 | 1083 | None | ○ | ○ | ○ | None | Δ | Δ | Δ |
| 6 | 98 | 171 | 21.1 | 3.5 | 1045 | None | ○ | ○ | ○ | None | ○ | ○ | ○ |
| 7 | 96 | 202 | 13.8 | 8.1 | 1002 | None | ○ | ○ | ○ | None | ○ | ○ | ○ |
| 8 | 97 | 217 | 10.1 | 13.0 | 985 | None | ○ | ○ | ○ | None | ○ | ○ | ○ |
| 9 | 96 | 142 | 10.3 | 18.3 | 1061 | None | ○ | ○ | ○ | None | ○ | ○ | ○ |
| 21* | 96 | 198 | 9.7 | 15.1 | 1131 | None | Δ | Δ | Δ | Yes | — | — | X |
| 22* | 97 | 204 | 12.1 | 10.4 | 1280 | Yes | — | — | X | Yes | — | — | X |
| 30 | 96 | 145 | 9.5 | 19.7 | 1054 | None | ○ | ○ | ○ | None | ○ | ○ | ○ |
| 31 | 95 | 155 | 11.0 | 15.7 | 1032 | None | ○ | ○ | ○ | None | ○ | ○ | ○ |
| 32 | 97 | 158 | 8.5 | 20.9 | 1067 | None | ○ | ○ | ○ | None | ○ | ○ | ○ |
| 40 | 96 | 150 | 15.8 | 9.7 | 1031 | None | ○ | ○ | ○ | None | ○ | ○ | ○ |
| 41* | 97 | 158 | 10.3 | 16.8 | 1051 | Yes | — | — | X | Yes | — | — | X |
| 42 | 97 | 156 | 8.3 | 21.6 | 1072 | None | ○ | ○ | ○ | None | ○ | ○ | ○ |

Asterisked sample numbers denote comparative examples.

TABLE 4

| | Structure and properites of wire rod | | | | | Drawing speed (800 m/min) | | | |
|---|---|---|---|---|---|---|---|---|---|
| Sample No. | Pearlite area ratio (%) | Average lamella space (nm) | Average nodule diameter (μm) | Value of F | TS (MPa) | Breakage | Surface state | Die life | Overall rating |
| 30 | 96 | 145 | 9.5 | 19.7 | 1054 | None | ○ | ○ | ○ |
| 31 | 95 | 155 | 11.0 | 15.7 | 1032 | None | ○ | ○ | ○ |
| 32 | 97 | 158 | 8.5 | 20.9 | 1067 | None | ○ | ○ | ○ |
| 40 | 96 | 150 | 15.8 | 9.7 | 1031 | Yes | — | — | X |
| 41* | 97 | 158 | 10.3 | 16.8 | 1051 | Yes | — | — | X |
| 42 | 97 | 156 | 8.3 | 21.6 | 1072 | Yes | — | — | X |

Asterisked sample numbers denote comparative examples.

It is noted from Tables 3 and 4 that samples Nos. 1 to 9, which have the chemical composition and pearlite structure meeting the requirements of the present invention, gave good results regardless of drawing speeds. By contrast, samples Nos. 21 and 22, which contain Nb or V more than specified, had very high strength due to precipitation strengthening of these elements. Particularly, sample No. 22 was poor in drawability as indicated by breakage during high-speed drawing. Moreover, Samples Nos. 30 to 32 (according to the present invention), which contains aluminum and nitrogen in a well-balanced ratio, exhibit good drawability at a drawing speed as high as 800 m/min. By contrast, Sample No. 40, which contains sufficient aluminum but contains very little nitrogen, and Sample No. 42, which contains excess aluminum, exhibit good drawability at a drawing speed up to 600 m/min but suffer breakage at a high drawing speed of 800 m/min. Also, Sample No. 41 is poor in drawability due to excess nitrogen (0.0055%) despite its adequate amount of aluminum.

EXAMPLE C

A high-carbon steel having the composition (shown below) specified in the present invention was prepared. The steel was made into a billet by continuous casting. The billet was made into a wire rod, 5.5 mm in diameter, by hot-rolling at a finish temperature as shown in Table 5. Immediately after hot-rolling, the wire rod was cooled according to the cooling curve shown in FIG. 1 and the cooling scheme (cooling rate, final cooling temperature, and cooling time) shown in Table 5. The first stage cooling was by water-quenching, the second and fourth stage cooling was by air-blast quenching, and the third stage cooling was by natural cooling without air blast.

Steel composition (mass %, remainder Fe)

C: 0.816%, Si: 0.15%, Mn: 0.46%, P: 0.007%, S: 0.005%, and N: 0.0025%

The resulting wire rod samples were examined for tensile strength, pearlite area ratio, average lamella space, average nodule diameter, and drawability. The results are shown in Table 6.

TABLE 5

| | Finish | First stage cooling | | Second stage cooling | | Third stage cooling | | Fourth stage cooling | |
|---|---|---|---|---|---|---|---|---|---|
| Sample No. | temperature of hot rolling (° C.) | Cooling rate (° C/s) | Final temperature (° C.) | Cooling rate (° C./s) | Final temperature (° C.) | Cooling rate (° C./s) | Final temperature (° C.) | Cooling rate (° C./s) | Final temperature (° C.) |
| 1 | 944 | 84 | 833 | 14 | 657 | 1.1 | 40 | 14 | 245 |
| 2 | 820 | 81 | 755 | 13 | 664 | 0.9 | 41 | 12 | 273 |
| 3 | 1035 | 72 | 840 | 13 | 657 | 1.0 | 35 | 11 | 255 |
| 4 | 936 | 79 | 884 | 11 | 658 | 0.6 | 38 | 10 | 251 |
| 5 | 931 | 65 | 832 | 18 | 655 | 1.4 | 44 | 11 | 251 |
| 6 | 913 | 74 | 836 | 7 | 662 | 1.1 | 49 | 15 | 240 |
| 7 | 890 | 81 | 640 | 12 | 674 | 0.5 | 50 | 13 | 231 |
| 8 | 935 | 69 | 834 | 11 | 628 | 0.8 | 45 | 14 | 250 |
| 9 | 916 | 76 | 835 | 15 | 664 | 1.7 | 39 | 12 | 240 |
| 10 | 944 | 66 | 840 | 10 | 664 | 0.9 | 26 | 11 | 261 |
| 11 | 926 | 72 | 826 | 13 | 669 | 1.2 | 38 | 15 | 437 |
| 21* | 1092 | 82 | 835 | 11 | 669 | 1.3 | 39 | 11 | 247 |
| 22* | 1070 | 35 | 955 | 15 | 643 | 1.5 | 50 | 12 | 257 |
| 23* | 908 | 72 | 923 | 12 | 644 | 0.6 | 39 | 10 | 275 |
| 24* | 907 | 73 | 826 | 29 | 657 | 0.9 | 52 | 14 | 239 |
| 25* | 947 | 84 | 843 | 11 | 695 | 1.0 | 44 | 14 | 232 |
| 26* | 915 | 77 | 842 | 10 | 610 | 0.6 | 52 | 12 | 263 |
| 27* | 919 | 66 | 844 | 10 | 668 | 2.8 | 45 | 14 | 253 |
| 28* | 947 | 78 | 837 | 11 | 651 | 1.4 | 15 | 11 | 244 |
| 29* | 1100 | 82 | 910 | (10) | (784) | (10) | (10) | (10) | (284) |

Asterisked sample numbers denote comparative examples.

TABLE 6

| | Structure and properties of wire rod | | | | | Drawing speed (300 m/min) | | | | Drawing speed (600 m/min) | | | |
|---|---|---|---|---|---|---|---|---|---|---|---|---|---|
| Sample No. | Pearlite area ratio (%) | Average lamella space (nm) | Average nodule diameter (μm) | Value of F | TS (MPa) | Breakage | Surface state | Die life | Overall rating | Breakage | Surface state | Die life | Overall rating |
| 1 | 98 | 200 | 20.1 | 2.2 | 1004 | None | ○ | ○ | ○ | None | ○ | ○ | ○ |
| 2 | 98 | 202 | 10.3 | 13.6 | 1002 | None | ○ | ○ | ○ | None | ○ | ○ | ○ |
| 3 | 97 | 198 | 22.9 | 0.4 | 1007 | None | ○ | ○ | ○ | None | ○ | ○ | ○ |
| 4 | 96 | 193 | 22.3 | 1.1 | 1013 | None | ○ | ○ | ○ | None | ○ | ○ | ○ |
| 5 | 97 | 192 | 22.4 | 1.1 | 1015 | None | ○ | ○ | ○ | None | ○ | ○ | ○ |
| 6 | 96 | 206 | 22.2 | 0.4 | 997 | None | ○ | ○ | ○ | None | ○ | ○ | ○ |
| 7 | 97 | 301 | 15.2 | 1.9 | 913 | None | ○ | ○ | ○ | None | ○ | ○ | ○ |
| 8 | 98 | 136 | 14.2 | 12.9 | 1110 | None | ○ | ○ | ○ | None | Δ | Δ | Δ |
| 9 | 97 | 202 | 22.5 | 0.4 | 1002 | None | ○ | ○ | ○ | None | ○ | ○ | ○ |
| 10 | 97 | 168 | 18.7 | 5.4 | 1049 | None | ○ | ○ | ○ | None | ○ | ○ | ○ |
| 11 | 96 | 208 | 17.0 | 4.2 | 994 | None | ○ | ○ | ○ | None | ○ | ○ | ○ |
| 21* | 95 | 197 | 35.1 | −4.7 | 1007 | None | ○ | ○ | ○ | Yes | — | — | X |
| 22* | 95 | 211 | 34.6 | −5.4 | 991 | None | ○ | ○ | ○ | Yes | — | — | X |
| 23* | 96 | 210 | 29.7 | −3.6 | 992 | None | ○ | ○ | ○ | Yes | — | — | X |
| 24* | 97 | 194 | 18.4 | 3.8 | 1011 | None | ○ | ○ | ○ | Yes | — | — | X |
| 25* | 98 | 391 | 20.4 | −5.1 | 853 | None | ○ | ○ | ○ | Yes | — | — | X |
| 26* | 97 | 95 | 19.5 | 13.8 | 1228 | None | ○ | ○ | ○ | Yes | — | — | X |
| 27* | 96 | 96 | 20.3 | 13.0 | 1224 | None | ○ | ○ | ○ | Yes | — | — | X |
| 28* | 95 | 94 | 19.0 | 14.4 | 1231 | None | ○ | ○ | ○ | Yes | — | — | X |
| 29* | 95 | 119 | 49.0 | −1.0 | 1190 | None | ○ | ○ | ○ | Yes | — | — | X |

Asterisked sample numbers denote comparative examples.

It is noted from Table 5 that samples Nos. 1 to 11, which were prepared by hot rolling and cooling under the conditions specified in the invention, gave good drawability because they meet the requirements of the invention for average lamella space, average nodule diameter, and F value.

By contrast, comparative examples were poor in drawability when drawn at a high speed. Sample No. 21 broke during high-speed drawing because of the high rolling temperature (exceeding 1050° C.) and hence the large average nodule diameter, and the F value smaller than 0. Sample No. 22 broke during high-speed drawing because of the large average nodule diameter and the F value smaller than zero which result from the low cooling rate (35° C./s) in the first stage cooling that immediately follows finish rolling. Sample No. 23 broke during high-speed drawing because of the large average nodule diameter and the F value smaller than zero which result from the high cooling temperature (923° C.) exceeding 900° C. in the first stage cooling. Another reason is thick scale with poor descalability. Sample No. 24 broke during high-speed drawing because of coarse nodules (despite the sufficiently large lamella space) and the F value smaller than zero, which result from the high final temperature (695° C.) in the second stage cooling and the high starting temperature (exceeding 680° C.) in the third stage cooling. Sample No. 25 broke during high-speed drawing because of coarse nodules (despite the sufficiently large lamella space) and the F value smaller than zero, which result from the high final temperature (695° C.) in the second stage cooling and the starting temperature (exceeding 680° C.) in the third stage cooling. Both sample No. 26 and sample No. 27 broke during high-speed drawing because of the excessively narrow lamella space (with the average lamella space being smaller than 100 nm) and excessively high strength. The former results from the excessively low final temperature (610° C.) in the second stage cooling, and the latter results from the excessively high cooling rate (2.8° C./s) in the third stage cooling. Sample No. 28 broke during high-speed drawing because of the average lamella space smaller than 100 nm and excessively high strength, which result from the excessively short cooling time in the third stage cooling. (Under this cooling condition, pearlite transformation does not proceed sufficiently in the high-temperature region but proceeds in the low-temperature region in the fourth stage cooling.) Sample No. 29 broke during high-speed drawing because of the large average nodule diameter although the average lamella space is wide and the average colony diameter is as small as 40 μm. The reason for this is that the cooling temperature was lowered at a constant rate (according to the conventional technology) in place of the stepped cooling.

EXAMPLE D

A high-carbon steel having the composition (shown below) specified in the present invention was prepared. The steel was made into a billet by continuous casting as in Example C. The billet was made into a wire rod, 5.5 mm in diameter, by hot-rolling at a finish temperature as shown in Table 7. The wire rod was drawn in the same way as in Example C except that the cooling rate was varied, and the effect of cooling rate on the product properties was examined. The results are shown in Tables 8-1 and 8-2.

Steel composition (mass %, remainder: Fe)

C: 0.790%, Si: 0.18%, Mn: 0.38%, P: 0.006%, S: 0.009%, N: 0.0035%, and Al: 0.018%.

TABLE 7

| Sample No. | Finish temperature of hot rolling (° C.) | First stage cooling Cooling rate (° C/s) | First stage cooling Final temperature (° C.) | Second stage cooling Cooling rate (° C./s) | Second stage cooling Final temperature (° C.) | Third stage cooling Cooling rate (° C./s) | Third stage cooling Final temperature (° C.) | Fourth stage cooling Cooling rate (° C./s) | Fourth stage cooling Final temperature (° C.) |
|---|---|---|---|---|---|---|---|---|---|
| 31 | 950 | 84 | 830 | 12 | 662 | 1.4 | 40 | 14 | 247 |
| 32 | 1000 | 70 | 860 | 13 | 660 | 1.1 | 38 | 12 | 285 |
| 33 | 936 | 77 | 825 | 11 | 639 | 1.2 | 45 | 13 | 254 |
| 41* | 1100 | 80 | 960 | 14 | 678 | 1.5 | 65 | 15 | 295 |
| 42* | 960 | 75 | 840 | 4 | 715 | 1.4 | 40 | 12 | 389 |

Asterisked sample numbers denote comparative examples.

TABLE 8-1

| Sample No. | Structure and properties of wire rod: Pearlite area ratio (%) | Average lamella space (nm) | Average nodule diameter (μm) | Value of F | TS (MPa) | Drawing speed (300 m/min): Breakage | Surface state | Die life | Overall rating | Drawing speed (600 m/min): Breakage | Surface state | Die life | Overall rating |
|---|---|---|---|---|---|---|---|---|---|---|---|---|---|
| 31 | 96 | 148 | 8.3 | 22.3 | 1054 | None | ○ | ○ | ○ | None | ○ | ○ | ○ |
| 32 | 98 | 159 | 8.5 | 20.8 | 1032 | None | ○ | ○ | ○ | None | ○ | ○ | ○ |
| 33 | 95 | 144 | 9.2 | 20.5 | 1067 | None | ○ | ○ | ○ | None | ○ | ○ | ○ |
| 41* | 97 | 150 | 36 | −1.38 | 1070 | Yes | — | — | — | Yes | — | — | — |
| 42* | 96 | 155 | 42 | −3.46 | 965 | Yes | — | — | — | Yes | — | — | — |

Asterisked sample numbers denote comparative examples.

TABLE 8-2

| Sample No. | Drawing speed 800 m/min: Breakage | Surface state | Die life | Overall rating |
|---|---|---|---|---|
| 31 | None | ○ | ○ | ○ |
| 32 | None | ○ | ○ | ○ |
| 33 | None | ○ | ○ | ○ |
| 41* | Yes | — | — | — |
| 42* | Yes | — | — | — |

Asterisked sample numbers denote comparative examples.

It is noted from Tables 8-1 and 8-2 that Samples Nos. 31 to 33, which were prepared by hot rolling and cooling under the conditions specified in the present invention, exhibit good drawing properties at drawing speeds up to 800 m/min owing to the adequate aluminum content. Comparative Sample No. 41 suffered breakage during drawing on account of the large average nodule diameter and the negative F value, which are attributable to the high finish temperature of hot rolling (exceeding 1050° C.) and the high final temperature in the first cooling stage (exceeding 900° C.). Comparative Sample No. 42 also suffered breakage during drawing on account of the large average nodule diameter and the negative F value, which are attributable to the low cooling rate in the second cooling stage (lower than 5° C.) and the high final temperature in the second cooling stage (exceeding 680° C.)

[Effect of the Invention]

According to the present invention, the high-carbon steel wire rod has a specific chemical composition and contains pearlite more than 95 area % such that its average lamella space is larger than 100 nm. Moreover, it has a very small average nodule diameter which has never been achieved under the convention manufacturing condition which is designed for larger lamella space. These characteristics prevent breakage while keeping strength at an adequately low level. Therefore, the high-carbon steel wire rod of the present invention has superior drawability and contributes to a prolonged die life.

What is claimed is:

1. A high-carbon steel wire rod with superior drawability which has the chemical composition (in mass %) defined below:

C: 0.6–1.0%

Si : 0.1–1.5%

Mn : 0.3–0.9%

P : no more than 0.02%

S : no more than 0.03%

N: no more than 0.005% with the remainder being Fe and inevitable impurities, and a structure which is characterized in that pearlite accounts for no less than 95 area % and pearlite has an average nodule diameter (P μm) no larger than 30 μm and an average lamella space (S nm) more than 100 nm such that the value of F calculated by the formula below is larger than zero:

$$F=350.3/(S)^{0.5}+130.3/(P)^{0.5}-51.7.$$

2. The high-carbon steel wire rod as defined in claim 1, wherein the chemical composition additionally has either or both of the following components:

Nb: 0.020–0.050%

V: 0.05–0.20%.

3. The high-carbon steel wire rod as defined in claim 1, which further contains Al in an amount no more than 0.030% and N in an amount of 0.0015% to 0.005%.

4. A method for producing the high-carbon steel wire rod as defined in claim 1 which comprises the steps of hot-rolling with a finish temperature of 1050–8000° C., cooling immediately the hot-rolled rod to a temperature of 950–750° C. at a cooling rate no smaller than 50° C./s, cooling further the rod to a temperature of 620–680° C. at a cooling rate of 5–20° C./s, and cooling the rod for no less than 20 seconds at a cooling rate no larger than 20° C./s.

5. The method as defined in claim 4, in which the cooling at a cooling rate no larger than 2° C./s is followed by cooling below 300° C. at a cooling rate no smaller than 5° C./s.

6. The high-carbon steel wire rod as defined in claim 1, wherein the pearlite has an average lamella space (S nm) no smaller than 115 nm.

7. The high-carbon steel wire rod as defined in claim 1, wherein the pearlite has an average lamella space (S nm) no smaller than 150 nm.

8. The high-carbon steel wire rod as defined in claim 1, wherein the pearlite has an average nodule diameter (P $\mu$m) no smaller than 9.3 $\mu$m.

* * * * *

UNITED STATES PATENT AND TRADEMARK OFFICE

CERTIFICATE OF CORRECTION

PATENT NO. : 6,783,609 B2
DATED : August 31, 2004
INVENTOR(S) : Hata et al.

It is certified that error appears in the above-identified patent and that said Letters Patent is hereby corrected as shown below:

Title page,
Item [73], Assignee, should read:
-- [73] Assignee: Kabushiki Kaisha Kobe Seiko Sho (Kobe Steel, Ltd.), Kobe (JP) --

Signed and Sealed this

Fourteenth Day of December, 2004

JON W. DUDAS
*Director of the United States Patent and Trademark Office*